US006892707B2

(12) United States Patent
Reiter et al.

(10) Patent No.: US 6,892,707 B2
(45) Date of Patent: May 17, 2005

(54) SEALING DEVICE FOR A FUEL INJECTION VALVE

(75) Inventors: Ferdinand Reiter, Markgroeningen (DE); Jens Pohlmann, Schwieberdingen (DE); Achim Besemer, Güglingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/258,407

(22) PCT Filed: Feb. 21, 2002

(86) PCT No.: PCT/DE02/00624

§ 371 (c)(1),
(2), (4) Date: Nov. 5, 2003

(87) PCT Pub. No.: WO02/066819

PCT Pub. Date: Aug. 29, 2002

(65) Prior Publication Data

US 2004/0060544 A1 Apr. 1, 2004

(30) Foreign Application Priority Data

Feb. 21, 2001 (DE) ..... 101 08 194

(51) Int. Cl.[7] ..... F02M 55/02
(52) U.S. Cl. ..... 123/470
(58) Field of Search ..... 123/456, 468, 123/469, 470

(56) References Cited

U.S. PATENT DOCUMENTS 3,038,456 A * 6/1962 Dreisin ..... 123/470
4,528,959 A * 7/1985 Hauser, Jr. ..... 123/470
4,589,596 A * 5/1986 Stumpp et al. ..... 239/397.5
5,129,658 A * 7/1992 Berton et al. ..... 277/591
5,706,787 A * 1/1998 Fujikawa ..... 123/470
5,954,343 A * 9/1999 Sumida et al. ..... 277/434
6,155,236 A * 12/2000 Jehle et al. ..... 123/470
6,186,123 B1 * 2/2001 Maier et al. ..... 123/470
6,196,195 B1 * 3/2001 Trutschel et al. ..... 123/470
6,481,421 B1 * 11/2002 Reiter ..... 123/470
6,745,956 B1 * 6/2004 Bantle et al. ..... 239/533.3

FOREIGN PATENT DOCUMENTS

| | | |
|---|---|---|
| DE | 195 35 665 | 1/1999 |
| DE | 197 43 103 | 4/1999 |
| DE | 199 08 819 | 9/1999 |
| DE | 199 62 968 | 6/2001 |
| DE | 100 27 669 | 12/2001 |
| JP | 58 206 871 | 12/1983 |
| JP | 04 091 362 | 3/1992 |
| WO | WO 01 94776 | 12/2001 |

* cited by examiner

*Primary Examiner*—Thomas Moulis
(74) *Attorney, Agent, or Firm*—Kenyon & Kenyon

(57) ABSTRACT

A sealing device for sealing a fuel injector for fuel injection systems of internal combustion engines from a cylinder head, the fuel injector having a nozzle body at which a sealing element is disposed which has a sealing surface that is radially oriented towards the outside, including a sealing sleeve that is able to be slipped onto the sealing element and which is provided with a collar-shaped widening having a sealing surface oriented in the axial direction, which is in sealing contact with a contact surface in the cylinder head.

6 Claims, 2 Drawing Sheets

SEALING DEVICE FOR A FUEL INJECTION VALVE

FIELD OF THE INVENTION

The present invention relates to a sealing device.

BACKGROUND INFORMATION

From German Published Patent Application No. 197 35 665, a fuel injection system having a compensating element is known which is made up of a support body having a dome-shaped supporting surface. This compensating element supports a fuel injector in a receiving bore of a cylinder head. Disposed in a groove of the fuel injector in the ring gap between receiving bore and fuel injector is a sealing ring which seals the ring gap from the combustion chamber. Since the fuel injector rests on the spherically shaped domed surface with a supporting surface, the fuel injector can be mounted at an angle that deviates from the axis of the receiving bore by up to a certain amount, and can be pressed firmly into the receiving bore by appropriate means, e.g., a clamping shoe. This allows a simple adaptation to the fuel supply lines. Therefore, it is possible to compensate for tolerances in the manufacture and installation of the fuel injectors.

Disadvantageous in the fuel injector system known from German Published Patent Application No. 197 35 665 is that the geometry of the fuel injector must be changed to adapt to changed installation geometries in the cylinder head. The seal acting in the radial direction requires a high degree of positional accuracy of the receiving bore and the outer geometry of the fuel injector with respect to one another.

SUMMARY OF THE INVENTION

In contrast, the sealing device according to the present invention has the advantage that an adaptation to different geometries is uncomplicated and that the interface of the fuel injector and the adjacent component remains unchanged.

As a result of the sealing surface formed in the axial direction at the sealing sleeve, an uncomplicated working of the corresponding surface of the cylinder head is possible. Equally advantageous is the possibility of influencing the surface pressure acting on the axial sealing surface, by which the effects of component tolerances are diminished. The elastic sealing sleeve is also suitable for compensating for position and angle tolerances.

Moreover, the intermediate sleeve is advantageous for generating the axial force on the sealing sleeve by which the outer geometry of the fuel injector may be varied within a wide range with the use of an inexpensive component.

DETAILED DESCRIPTION

Figure 1:
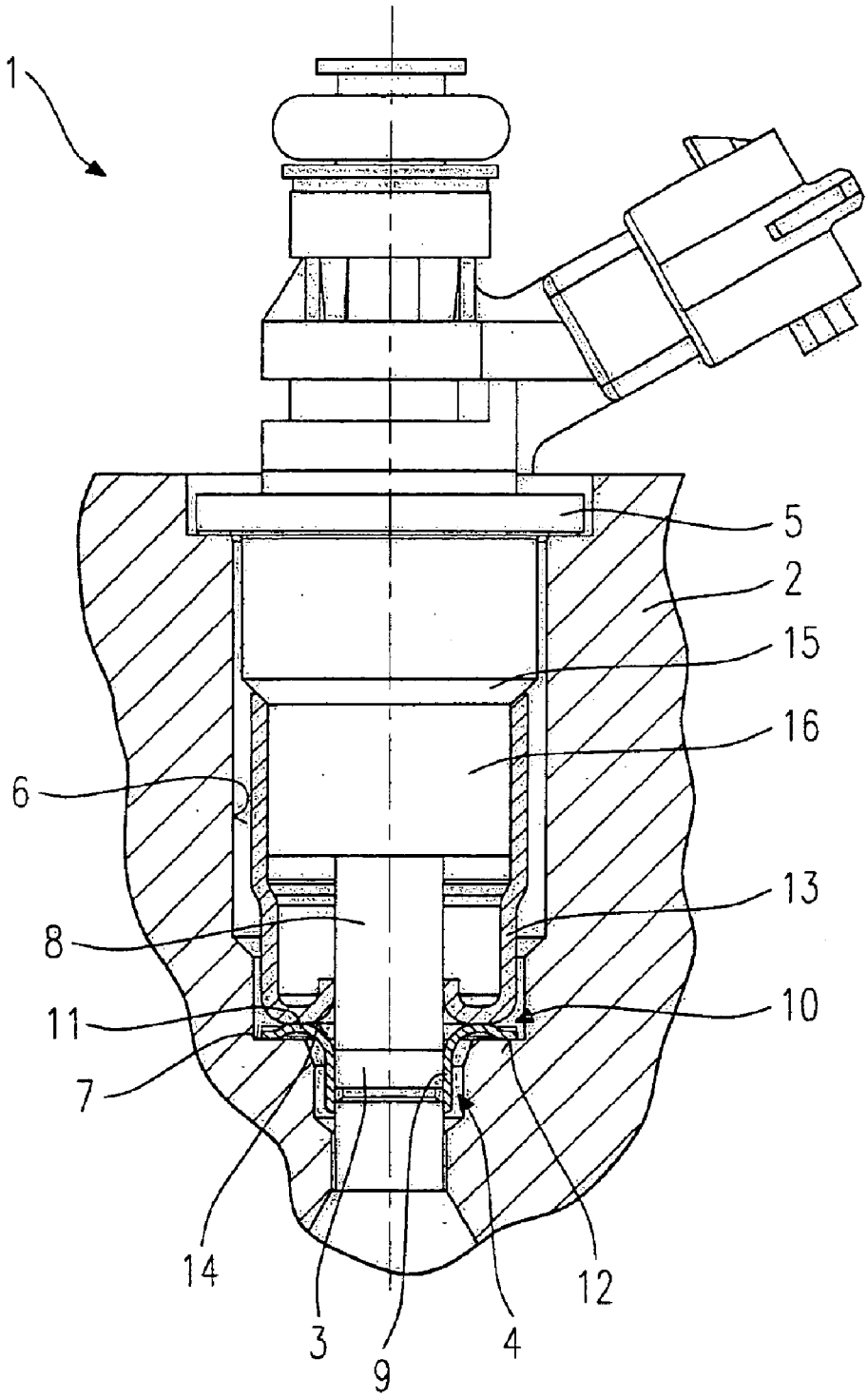
FIG. 1 shows a schematic partial section through a first exemplary embodiment of a sealing device according to the present invention.

A first exemplary embodiment is represented in FIG. 1. To seal a fuel injector 1 from a cylinder head 2 of an internal combustion engine having direct fuel injection, fuel injector

1 is sealed from a sealing sleeve 4 by a radially sealing sealing element 3. An intermediate sleeve 13 exerts pressure on sealing sleeve 4 in the axial direction, causing a sealing surface pressure to be generated between sealing sleeve 4 and cylinder head 2.

To receive fuel injector 1, cylinder head 2 has a receiving opening 6, which, in the direction of the combustion chamber of the internal combustion engine, has a shoulder that is configured as contact surface 7 for sealing sleeve 4.

At its downstream end, fuel injector 1 has a cylinder-shaped nozzle body 8 into which a circumferential groove has been introduced to receive sealing element 3. Sealing sleeve 4 has a hollow cylindrical section 9 whose inner radial extension corresponds to the radial extension of sealing element 3, so that sealing sleeve 4, together with sealing element 3, produces a sealing press-fit connection. On the upstream side of sealing sleeve 4 is a collar-shaped widening 10, whose outer radial extension is greater than the inner radial extension of the shoulder in receiving opening 6 of cylinder head 2.

Collar-shaped widening 10 has a camber 11 formed in the upstream direction. Toward the outer circumference, camber 11 transitions to a second camber facing in the opposite direction, at whose downstream-facing side is an axial sealing surface 12. Axial sealing surface 12 and contact surface 7 of receiving opening 6 form a sealing seat.

An intermediate sleeve 13, which is also able to be slid onto nozzle body 8 of fuel injector 1, presses sealing sleeve 4 onto contact surface 7. At the downstream end of intermediate sleeve 13, a pressure surface 14 is formed. It is created by the folding-over of the downstream end of intermediate sleeve 13 between the outer radial extension of intermediate sleeve 13 and the inner radial extension, which approximately corresponds to the maximal radial extension of sealing element 3. At the upstream end, intermediate sleeve 13 is supported at a circumferential chamfered shoulder 15 of fuel injector 1. In the process, intermediate sleeve 13 is slid over a housing part 16 of fuel injector 1.

The axial and radial extensions of circumferential camber 11 of sealing sleeve 4 are so large as to support camber 11 at pressure surface 14 formed by intermediate sleeve 13. Camber 11 of sealing sleeve 4 is configured such that axial sealing surface 12 is the only contact surface of sealing sleeve 4 and contact surface 7 of receiving opening 6. Intermediate sleeve 13 transmits at least part of the axial force that is exerted on fuel injector 1 by a mounting element, not depicted further, to camber 11 of sealing sleeve 4 and thus to axial sealing surface 12. This elastically deforms sealing sleeve 4 clamped between intermediate sleeve 13 and cylinder head 2. The tension thus built up in sealing sleeve 4 makes it possible to compensate for component tolerances, without reducing the sealing effect. A clamping foot, for example, may be used as mounting element, which presses fuel injector 1 against cylinder head 2 using a flange 5 provided for this purpose. In a load-free state, the axial space between the downstream side of flange 5 and the sealing surface of sealing sleeve 4 is larger than the space between the respective corresponding contact surface, so that a tension is always built up in sealing sleeve 4 during installation of fuel injector 1 in cylinder head 2, which generates the sealing surface pressure of sealing surface 12 on contact surface 7.

During installation, intermediate sleeve 13 is first slid onto fuel injector 1. Then, sealing sleeve 4 is slid onto fuel injector 1, which holds intermediate sleeve 13 on fuel injector 1. The forces generated to build up a sufficient sealing effect between sealing element 3 and sealing sleeve 4 are large enough to be able to use sealing sleeve 4 as mounting aid when inserting fuel injector 1.

Figure 2:
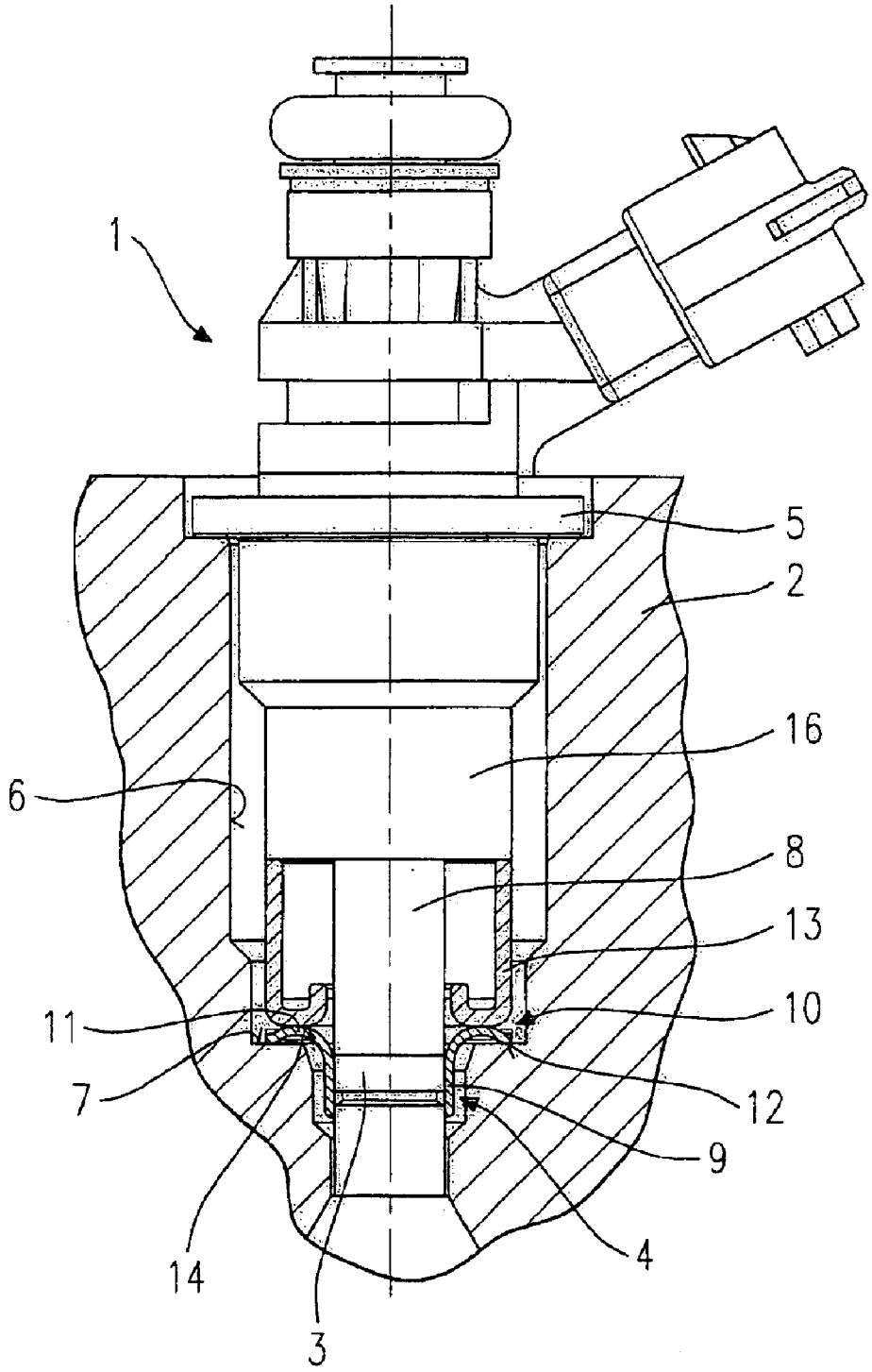
FIG. 2 shows a schematic section through a second exemplary embodiment of a sealing device according to the present invention.

FIG. 2 shows a second exemplary embodiment using a modified form of intermediate sleeve 13. Intermediate sleeve 13 is implemented in a shortened form and does not surround housing part 16 of fuel injector 1, but instead is supported on its downstream side. Due to the shortened design of intermediate sleeve 13, the introduced heat is better able to dissipate.

Connecting sealing sleeve 4 directly to nozzle body 8 and to cylinder head 2 provides good heat dissipation into cylinder head 2 during operation of the internal combustion engine. Sealing sleeve 4 is preferably manufactured from spring-elastic, low-alloyed high-grade steel, spring-hard CuSn6, or CuBe2. Through the choice of materials, it is possible to adapt sealing sleeve 4 to the respective application with respect to mechanical properties and also corrosion resistance and heat dissipation.

What is claimed is:

1. A sealing device for sealing a fuel injector for a fuel injection system of an internal combustion engine from a cylinder head, comprising:

a first sealing element disposed at a nozzle body of the fuel injector, the first sealing element including a first sealing surface oriented radially outwardly; and a sealing sleeve configured as a second sealing element that is slidable onto the first sealing element and that is provided with a collar shaped widening including a second sealing surface that is oriented in an axial direction, the second sealing surface being in sealing contact with a contact surface in the cylinder head.

2. The sealing device as recited in claim 1, wherein:

the second sealing surface is located at an outer circumference of the collar shaped widening.

3. The sealing device as recited in claim 1, wherein:

the collar shaped widening includes a circumferential camber that is oriented oppositely to a side facing away from the second sealing surface.

4. The sealing device as recited in claim 3, wherein:

the sealing sleeve is elastically deformable by applying a force to the circumferential camber in the axial direction, and a tension generates a sealing surface pressure of the second sealing surface.

5. A sealing device for sealing a fuel injector for a fuel injection system of an internal combustion engine from a cylinder head, comprising:

a sealing element disposed at a nozzle body of the fuel injector, the sealing element including a first sealing surface oriented radially outwardly;

a sealing sleeve that is slidable onto the sealing element and that is provided with a collar shaped widening including a second sealing surface that is oriented in an axial direction, the second sealing surface being in sealing contact with a contact surface in the cylinder head;

an intermediate sleeve that is slid onto the fuel injector and in the axial direction is provided with a pressure surface oriented toward the sealing sleeve, wherein:

the collar shaped widening includes a circumferential camber that is oriented oppositely to a side facing away from the second sealing surface;

the sealing sleeve is elastically deformable by applying a force to the circumferential camber in the axial direction:

a tension generates a sealing surface pressure of the second sealing surface; and a radial extension of the intermediate sleeve corresponds to a radial extension of the circumferential camber of the sealing sleeve.

6. The sealing device as recited in claim 5, wherein:

the sealing sleeve is in contact, by way of the circumferential camber, with the pressure surface of the intermediate sleeve.

* * * * *